United States Patent [19]

Datta

[11] 4,115,161

[45] Sep. 19, 1978

[54] PROCESSING FOR CUBE-ON-EDGE ORIENTED SILICON STEEL

[75] Inventor: Amitava Datta, Pittsburgh, Pa.

[73] Assignee: Allegheny Ludlum Industries, Inc., Pittsburgh, Pa.

[21] Appl. No.: 841,402

[22] Filed: Oct. 12, 1977

[51] Int. Cl.[2] ..... H01F 1/04

[52] U.S. Cl. ..... 148/111; 148/31.55; 148/112; 148/113

[58] Field of Search ..... 148/113, 111, 112, 31.55

[56] References Cited

U.S. PATENT DOCUMENTS

| | | | |
|---|---|---|---|
| 2,965,526 | 12/1960 | Wiener | 148/111 |
| 3,873,381 | 3/1975 | Jackson | 148/112 |
| 3,905,842 | 9/1975 | Grenoble | 148/111 |
| 3,905,843 | 9/1975 | Fiedler | 148/111 |
| 3,957,546 | 5/1976 | Fiedler | 148/111 |
| 4,030,950 | 6/1977 | Shilling et al. | 148/112 |
| 4,054,471 | 10/1977 | Datta | 148/113 |

*Primary Examiner*—W. Stallard

*Attorney, Agent, or Firm*—Vincent G. Gioia; Robert F. Dropkin

[57] ABSTRACT

A process for producing electromagnetic silicon steel having a cube-on-edge orientation and a permeability of at least 1870 (G/Oe) at 10 oersteds. The process includes the steps of: preparing a melt of silicon steel containing from 0.02 to 0.06% carbon, from 0.0006 to 0.0080% boron, up to 0.0100% nitrogen, no more than 0.008% aluminum and from 2.5 to 4.0% silicon; casting said steel; hot rolling said steel; cold rolling said steel to a thickness no greater than 0.020 inch; recrystallizing the cold rolled steel at a temperature between 1300° and 1550° F in a hydrogen-bearing atmosphere having a dew point of from +50° to +150° F; decarburizing said steel to a carbon level below 0.005%; applying a refractory oxide base coating to said steel; and final texture annealing said steel. The steel is heated to said temperature range of between 1300° and 1550° F at a heating rate of at least 1500° F per minute and held within said temperature range for a period of at least 30 seconds.

14 Claims, 2 Drawing Figures

PROCESSING FOR CUBE-ON-EDGE ORIENTED SILICON STEEL

The present invention relates to an improvement in the manufacture of grain-oriented silicon steel.

Several recently issued patents disclose a new breed of, boron-inhibited, electromagnetic silicon steels. These patents which include U.S. Pat. Nos. 3,873,381, 3,905,842, 3,905,843 and 3,957,546; all call for a final normalize at a temperature of from 1475° to 1500° F.

A process aimed at improving the magnetic properties of said patents is disclosed in U.S. patent application Ser. No. 696,964, filed June 17, 1976, and now U.S. Pat. No. 4,054,471. Speaking broadly, said application discloses a process wherein boron-bearing steel is final normalized at a temperature of from 1550° to 2000° F.

Through the present invention, there is now provided another process for improving the magnetic properties of boron-inhibited electromagnetic silicon steel. Cold rolled steel of final gage is heated to its normalizing temperature at a rate of at least 1500° F. per minute. A rapid heating rate has been found to improve magnetic properties. Typical heating rates for boron-inhibited silicon steels have been approximately 1000° F. per minute; and although there has been a disclosure of higher rates for conventional silicon steel, U.S. Pat. No. 2,965,526, such disclosure is not relevant. Conventional silicon steels are characterized by processing and chemistries unlike those of boron-inhibited silicon steels.

In addition to improving magnetics, a higher heating rate allows for the use of a more oxidizing atmosphere. Although it is not known for sure why this is so, it is hypothesized that less surface boron is lost during rapid heating; and as known to those skilled in the art, loss of boron induces primary grain growth and a deterioration of magnetic properties. With a more oxidizing atmosphere, decarburization proceeds more effectively, and a higher quality base coating is subsequently obtained. A certain amount of oxygen present as oxides in the scale is beneficial in rendering the surfaces of the steel susceptible to the formation of a wide variety of base coatings; U.S. Pat. No. 4,030,950.

It is accordingly an object of the present invention to provide an improvement in the manufacture of grain-oriented silicon steel.

The foregoing and other objects of the invention will be best understood from the following description, reference being had to the accompanying drawings wherein.

Figure 2:
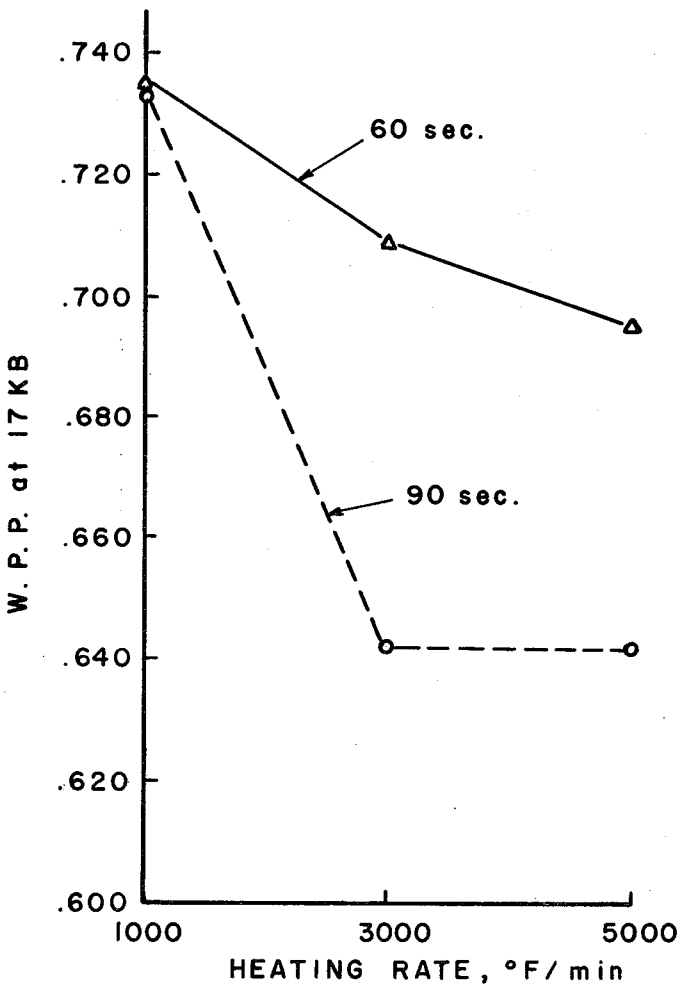
FIG. 2 is a plot of core loss versus heating rate.

In accordance with the present invention a melt of silicon steel containing from 0.02 to 0.06% carbon, from 0.0006 to 0.0080% boron, up to 0.0100% nitrogen, no more than 0.008% aluminum and from 2.5 to 4.0% silicon is subjected to the conventional steps of casting, hot rolling, one or more cold rollings to a thickness no greater than 0.020 inch, an intermediate normalize when two or more cold rollings are employed, recrystallizing at a temperature between 1300° and 1550° F. in a hydrogen-bearing atmosphere having a dew point of from +50° to +150° F., decarburizing to a carbon level below 0.005%, application of refractory oxide base coating, and final texture annealing; and to the improvement comprising the step of heating the steel to the temperature range of between 1300° and 1550° F. at a heating rate of at least 1500° F. per minute. Specific processing, as to the conventional steps, is not critical and can be in accordance with that specified in the other patents dealing with boron-inhibited steels. Moreover, the term casting is intended to include continuous casting processes. A hot rolled band heat treatment is also includable within the scope of the present invention. It is, however, preferred to cold roll the steel to a thickness no greater than 0.020 inch, without an intermediate anneal between cold rolling passes; from a hot rolled band having a thickness of from about 0.050 to about 0.120 inch. Melts consisting essentially of, by weight, 0.02 to 0.06% carbon, 0.015 to 0.15% manganese, 0.01 to 0.05% of material from the group consisting of sulfur and selenium, 0.0006 to 0.0080% boron, up to 0.0100% nitrogen, 2.5 to 4.0% silicon, up to 1.0% copper, no more than 0.008% aluminum, balance iron, have proven to be particularly adaptable to the subject invention. Boron levels are usually in excess of 0.0008%. The refractory oxide base coating usually contains at least 50% MgO. Steel produced in accordance with the present invention has a permeability of at least 1870 (G/Oe) at 10 oersteds. Preferably, the steel has a permeability of at least 1890 (G/Oe) at 10 oersteds and a core loss of no more than 0.700 watts per pound at 17 kilogauss −60Hz.

The cold rolled steel is recrystallized at a temperature between 1300° and 1550° F., and preferably at a temperature between 1400° and 1500° F. Recrystallization will not occur at temperatures below 1300° F. Decarburization proceeds more effectively at temperatures below 1550° F. As noted hereinabove, the invention is dependent upon a heating rate of at least 1500° F. per minute. The heating rate is preferably at least 2000° F. per minute, and generally between 2000° and 5000° F. per minute. Time at temperature is at least 30 seconds, and preferably at least 60 seconds. This period is generally from 60 to 120 seconds. The hydrogen-bearing atmosphere can be one consisting essentially of hydrogen or one containing hydrogen admixed with nitrogen. A gas mixture containing 80% nitrogen and 20% hydrogen has been successfully employed. The dew point of the atmosphere is generally between 70° and 125° F.

The following examples are illustrative of several aspects of the invention.

Eighteen strips of cold rolled silicon steel were heated to 1475° F. in a resistance heated bell jar reaction chamber. The atmosphere in the bell jar was 80% nitrogen, 20% hydrogen with a dew point of 120° F. Three of the strips were heated to 1475° F. at a heating rate of 1000° F. per minute, and held at said temperature for a period of 60 seconds. Three others were similarly heated and held for 90 seconds. Other groups of three were respectively heated at rates of 3000° and 5000° F. per minute, and held for respective periods of 60 and 90 seconds. The strips, thus normalized, were coated with MgO + 0.75%B, and texture annealed at a maximum temperature of 2150° F.

Each of the strips was tested for permeability (at 10 Oe) and core loss (WPP at 17KB). The average strip value from each group of three was converted to the Epstein pack value using the following relationships:

$$\mu \text{ at 10 Oe (PACK)} = \mu \text{ at 10 Oe (STRIP)} + 24$$

$$WPP \text{ at } 17KB \text{ (PACK)} = \frac{WPP \text{ at } 17KB \text{ (STRIP)} + 0.127}{1.273}$$

Figure 1:
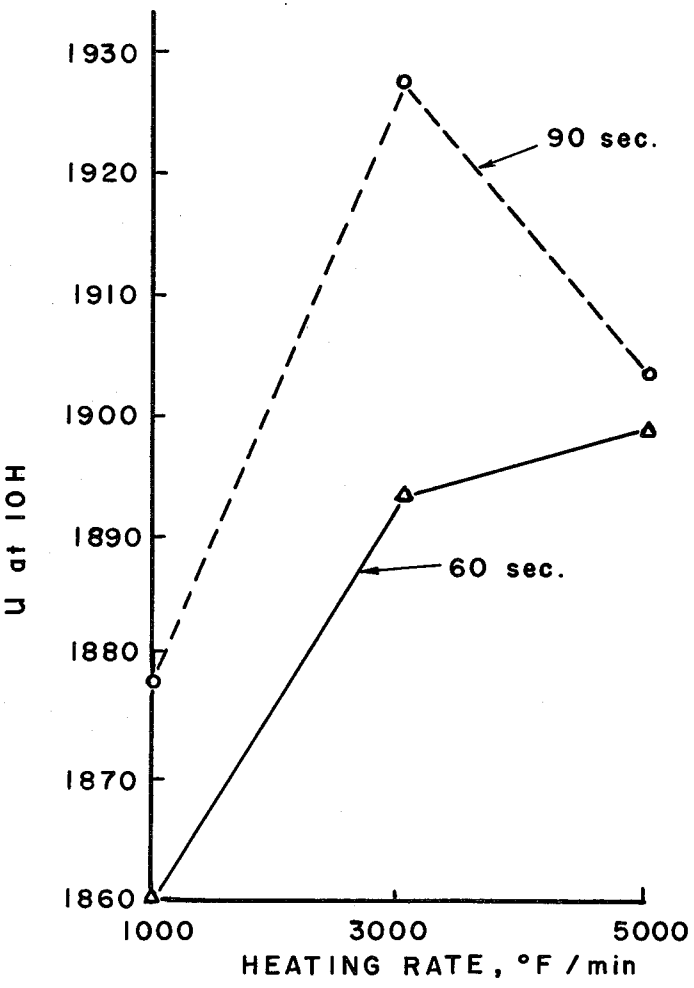
FIG. 1 is a plot of permeability versus heating rate.

The variations in permeability and core loss, for the packs, are plotted versus heating rates in FIGS. 1 and 2.

From FIGS. 1 and 2, it is clear that magnetic properties improve with fast heating rates. Permeabilities increase and core losses decrease as heating rates are increased from conventional values of 1000° F. to values in excess of 1500° F., and preferably, to values in excess of 2000° F.

Processing for the cold rolled strips involved soaking at an elevated temperature for several hours, hot rolling to a nominal gage of 0.080 inch, hot roll band normalizing at a temperature of approximately 1740° F. and cold rolling to a final gage of 0.012 inch. The melt chemistry for the steel was as follows:

| C | Mn | S | B | N | Si | Cu | Al | Fe |
|---|---|---|---|---|---|---|---|---|
| 0.043 | 0.035 | 0.020 | 0.0009 | 0.0049 | 3.24 | 0.34 | 0.004 | BAL |

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

I claim:

1. In a process for producing electromagnetic silicon steel having a cube-on-edge orientation and a permeability of at least 1870 (G/Oe) at 10 oersteds, which process includes the steps of: preparing a melt of silicon steel containing from 0.02 to 0.06% carbon, from 0.0006 to 0.0080% boron, up to 0.0100% nitrogen, no more than 0.008% aluminum and from 2.5 to 4.0% silicon; casting said steel; hot rolling said steel; cold rolling said steel to a thickness no greater than 0.020 inch; recrystallizing the cold rolled steel at a temperature between 1300° and 1550° F. in a hydrogen-bearing atmosphere having a dew point of from +50° to +150° F.; decarburizing said steel to a carbon level below 0.005%; applying a refractory oxide base coating to said steel; and final texture annealing said steel; the improvement comprising the steps of heating said steel to said temperature range of between 1300° and 1550° F. at a heating rate of at least 1500° F. per minute; and holding said steel within said temperature range for a period of at least 30 seconds.

2. The improvement according to claim 1, wherein said melt has at least 0.0008% boron.

3. The improvement according to claim 2, wherein said steel is heated to said temperature range of between 1300° and 1550° F. at a heating rate of at least 2000° F. per minute.

4. The improvement according to claim 3, wherein said steel is heated to said temperature range of between 1300° and 1550° F. at a heating rate of from 2000° to 5000° F. per minute.

5. The improvement according to claim 3, wherein said recrystallizing occurs at a temperature between 1400° and 1500° F.

6. The improvement according to claim 3, wherein said steel is held within said temperature range of between 1300° and 1550° F. for a period of at least 60 seconds.

7. The improvement according to claim 6, wherein said steel is held within said temperature range of between 1300° and 1550° F. for a period of from 60 to 120 seconds.

8. The improvement according to claim 3, wherein said recrystallizing occurs in a hydrogen-bearing atmosphere having a dew point of +70° to +125° F.

9. The improvement according to claim 3, wherein said hydrogen-bearing atmosphere consists essentially of hydrogen and nitrogen.

10. The improvement according to claim 2, wherein said hot rolled steel has a thickness of from 0.050 to 0.120 inch and wherein said hot rolled steel is cold rolled to a thickness of no more than 0.020 inch without an intermediate anneal between cold rolling passes.

11. The improvement according to claim 1, wherein said melt consists essentially of, by weight, 0.02 to 0.06% carbon, 0.015 to 0.15% manganese, 0.01 to 0.05% of material from the group consisting of sulfur and selenium, 0.0006 to 0.0080% boron, up to 0.0100% nitrogen, 2.5 to 4.0% silicon, up to 1.0% copper, no more than 0.008% aluminum, balance iron.

12. The improvement according to claim 11, wherein said melt has at least 0.0008% boron.

13. The improvement according to claim 1, wherein said oriented silicon steel has a permeability of at least 1890 (G/Oe) at 10 oersteds and a core loss of no more than 0.700 watts per pound at 17 kilogauss −60Hz.

14. A cube-on-edge oriented silicon steel having a permeability of at least 1870 (G/Oe) at 10 oersteds, and made in accordance with the process of claim 2.

* * * * *